US010065331B2

(12) United States Patent
Kasen

(10) Patent No.: US 10,065,331 B2
(45) Date of Patent: Sep. 4, 2018

(54) CATHETER CUTTING DEVICE

(71) Applicant: Teleflex Innovations S.à.r.l., Luxembourg (LU)

(72) Inventor: Eric Kasen, Maple Grove, MN (US)

(73) Assignee: Teleflex Innovations S.à.r.l., Luxembourg (LU)

( * ) Notice: Subject to any disclaimer, the term of this patent is extended or adjusted under 35 U.S.C. 154(b) by 53 days.

(21) Appl. No.: 15/063,575

(22) Filed: Mar. 8, 2016

(65) Prior Publication Data

US 2016/0346946 A1 Dec. 1, 2016

Related U.S. Application Data

(60) Provisional application No. 62/166,274, filed on May 26, 2015.

(51) Int. Cl.
*B26D 3/16* (2006.01)

(52) U.S. Cl.
CPC ..... *B26D 3/166* (2013.01)

(58) Field of Classification Search
CPC ... B26D 3/166; B26D 3/16; B26D 5/35; A47J 37/048; A47J 37/00; A47J 43/18; B05B 13/0242; B05B 13/0225; B24B 5/12; B24B 5/047; B24B 5/06; B24B 5/02; B24B 5/04; B24B 5/18; B24B 41/06; B23Q 1/40
See application file for complete search history.

(56) References Cited

U.S. PATENT DOCUMENTS

| | | | | |
|---|---|---|---|---|
| 2,697,395 A * | 12/1954 | Steriss | A47J 37/048 99/423 |
| 4,579,025 A * | 4/1986 | Fasolak | B23D 45/124 82/101 |
| 4,827,816 A | 5/1989 | Takaniemi | |
| 6,014,919 A | 1/2000 | Jacobsen et al. | |
| 8,250,960 B2 | 8/2012 | Hayner et al. | |
| 2008/0236358 A1 | 10/2008 | Vitullo et al. | |

* cited by examiner

*Primary Examiner* — Stephen Choi
*Assistant Examiner* — Liang Dong
(74) *Attorney, Agent, or Firm* — Gregory W. Smock

(57) ABSTRACT

A catheter cutting device can include a base, first and second support blocks coupled to the base, first and second roller shafts extending between and movably coupled to the first and second support blocks, and a sliding plate movably engaged with at least one of the support blocks or roller shafts such that movement of the sliding plate causes one or both of the first and second roller shafts to rotate. An arm including a cutting blade can extend in a direction perpendicular to the extension of the first and second roller shafts and can be coupled to the base or the sliding plate.

20 Claims, 11 Drawing Sheets

CATHETER CUTTING DEVICE

CLAIM OF PRIORITY

This non-provisional patent document claims the benefit of priority under 35 U.S.C. § 119(e) to U.S. Provisional Patent Application Ser. No. 62/166,274, entitled "CATHETER CUTTING DEVICE" and filed on May 26, 2015, which is herein incorporated by reference in its entirety.

BACKGROUND

Manufacture of medical catheters can require a straight cut at a precise angle along the length of a tube, such as a cut that is 90 degrees relative to a longitudinal axis of the tube. A tube that is cut at an undesirable angle or having uneven, nicked or rough edges can be unacceptable for medical uses and may need to be discarded.

Catheters can be formed from a plurality of tubular materials and the resulting composite structure can make precise tube cutting difficult.

OVERVIEW

The present inventor recognizes a need for a cutting device that can form a straight, smooth, and even cut at a desired location along the length of a tube. The present inventor further recognizes that the cutting device should be configured to make such cuts in tubing made from a plurality of materials, including polymers, metals, rubbers, fabrics, meshes or combinations of these materials.

The present cutting device can be configured to cut tubing made of uniform or composite materials. The cutting device can include a base or can be secured to an existing base, such as a work table or work bench. The cutting device can include a sliding plate that can be moved in at least two directions. The sliding plate can engage a movement assembly, such as a geared assembly, that can cause one or more roller shafts to rotate. Two roller shafts, for example, can be positioned between two support blocks. The support blocks can be secured to the base. A top surface of the support blocks can include a groove sized to stabilize a tube for cutting and can be aligned with the longitudinal axes of the roller shafts. As the sliding plate is moved, a tube positioned in the groves can be caused to rotate by way of the roller shafts.

The cutting device can further include a cutting blade used to cut the tube as it rotates. The cutting blade can be coupled to an arm, which can be secured to the sliding plate so that the blade can be lowered against the rotating tube in a stable and repeatable manner. The cutting blade can be moved in a forward or backward direction as it contacts the rotating tube. The arm can include an energy storage member, such as a spring, to return the blade to a default non-cutting position. The blade can be removable. The blade can be a razor blade.

These and other examples and features of the present cutting device and related methods will be set forth in part in the following Detailed Description. This Overview is intended to provide non-limiting examples of the present subject matter—it is not intended to provide an exclusive or exhaustive explanation. The Detailed Description below is included to provide further information about the present cutting device and related methods.

BRIEF DESCRIPTION OF THE DRAWINGS

In the drawings, like numerals can be used to describe similar features and components throughout the several views. The drawings illustrate generally, by way of example but not by way of limitation, various embodiments discussed in this patent document.

Figure 1:
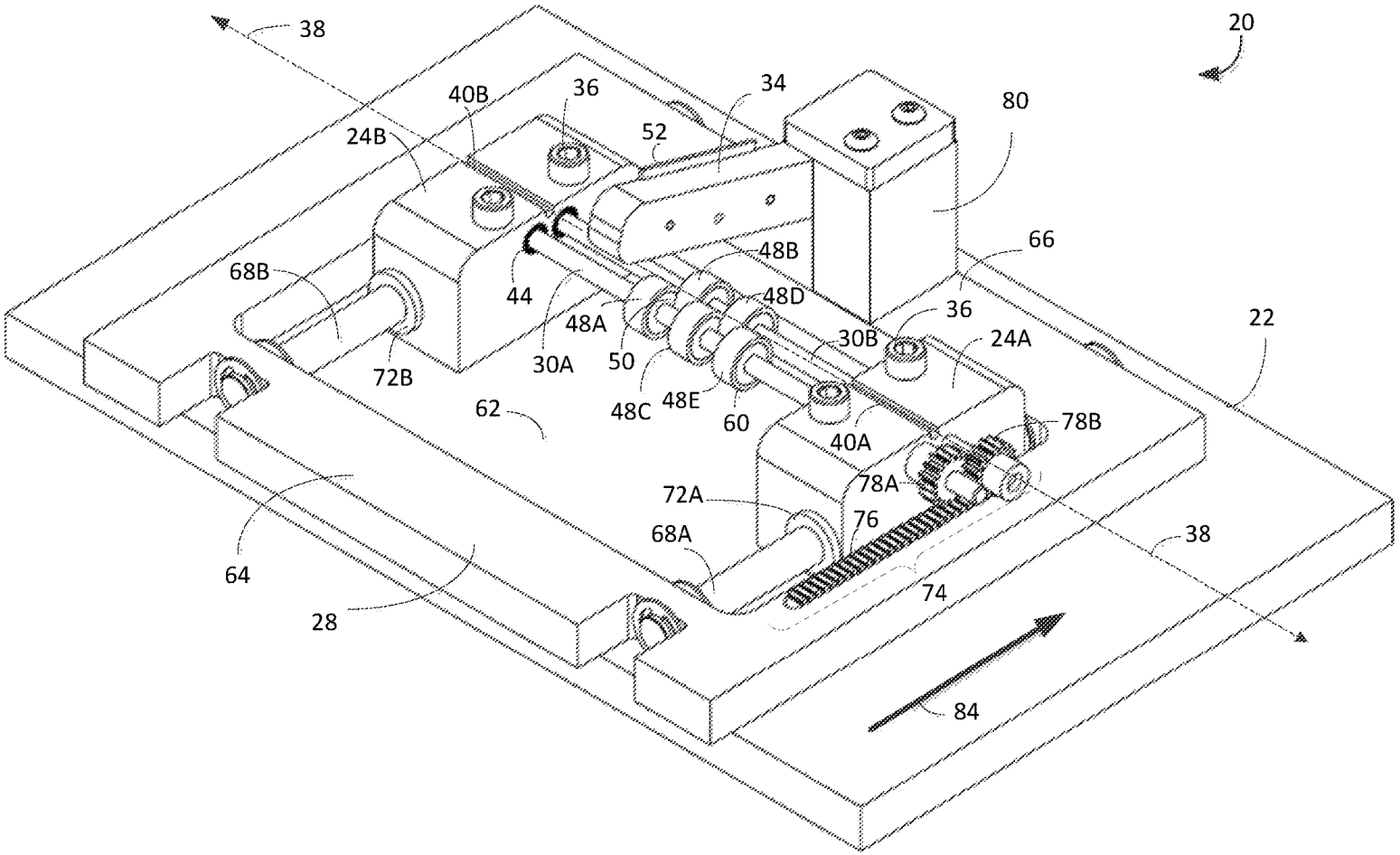
FIG. 1 illustrates a perspective view of a cutting device, in accordance with at least one example of the present disclosure.

The drawing figures are not necessarily to scale. Certain features and components may be shown exaggerated in scale or in schematic form, and some details may not be shown in the interest of clarity and conciseness.

DETAILED DESCRIPTION

FIG. 1 illustrates a perspective view of a cutting device 20. The cutting device 20 can be used to cut tubing for incorporation into a medical catheter, for example. The cutting device 20 can be configured to cut small diameter tubing, such as tubing about 3 Fr to 9 Fr (1 mm-3 mm) in diameter, or tubing having larger or smaller diameters. The tubing material can include polymers, metals, rubbers, fabrics, meshes, strands, or combinations of these materials. The materials can have a braided or coiled confirmation and can be grouped together to form a composite structure.

The cutting device 20 can include a base 22, a first support block 24A, a second support block 24B, a sliding plate 28, a first roller shaft 30A, a second roller shaft 30B, and an arm 34. The base 22 can provide a stable platform for other components of the cutting device 20. The base 22 can be a plate formed of metal, wood, polymer, or a composite material. In another example, the base 22 can be a pre-existing table or workbench.

The first support block 24A and the second support block 24B can be fastened to the base 22 by one or more fasteners 36. In another example, the first and second support blocks 24, 26 can be attached to the base 22 by other fastening means, such as welds or adhesives. In another example, the first and second support blocks 24, 26 can be formed integrally with the base 22. The first support block 24A can include a first groove 40A and the second support block can include a second groove 40B. The first and second grooves 40A, 40B can be aligned with a longitudinal axis 38 and can be configured to receive and stabilize tubing to be cut. The first and second grooves 40A, 40B can be configured as a partial cylinder and can be large enough so that the tubing can rotate within the groove.

The first and second roller shafts 30A, 30B can extend between the first and second support blocks 24A, 24B in a direction that is substantially parallel to the longitudinal axis 38. The first and second roller shafts 30A, 30B can be configured to rotate relative to the first and second support blocks 24A, 24B. In an example, the first and second roller shafts 30A, 30B can pass through the first support block 24A. The first and second support blocks 24A, 24B can include roller shaft bearing members 44 that can prevent wear between the roller shafts 30A, 30B and the support blocks 24A, 24B. The first roller shaft 30A can extend through a first roller 48A. The first roller 48A can be rotationally fixed to the first roller shaft 30A so that when the first roller shaft 30A rotates, the first roller 48A also rotates. The second roller shaft 30B can extend through a second roller 48B. The second roller 48B can be rotationally fixed to the second roller shaft 30B and can be adjacent to the first roller 48A. There can be a space 50 (see also FIG. 4) formed between the first roller 48A and the second roller 48B so that a cutting blade 52 can be lowered into the space 50 to cut the tubing.

The cutting device 20 can include a third roller 48C, a fourth roller 48D, and a fifth roller 48E. The rollers can form an assembly of rollers located on the first and second roller shafts 30A, 30B in an overlapping configuration. The overlapping intersection of the rollers can be aligned with the longitudinal axis 38, such that when tubing is placed in the first groove 40A and the second groove 40B, the tubing will engage rollers on the first roller shaft 30A and rollers on the second roller shaft 30B. In another example, the cutting device 20 can include a greater or lesser number of rollers with different alternating roller patterns. For example, instead of alternating every roller as shown between the first roller shaft 30A and the second roller shaft 30B, the rollers can be in pairs on one shaft that alternate with pairs of rollers on the other roller shaft. In another example, the rollers can be integral with the roller shafts. The rollers 48A-E can include an exterior covering 60 that can provide a surface having an increased gripping ability with an outer material of the tubing. The rollers 48A-E can have a textured exterior surface.

Figure 3:
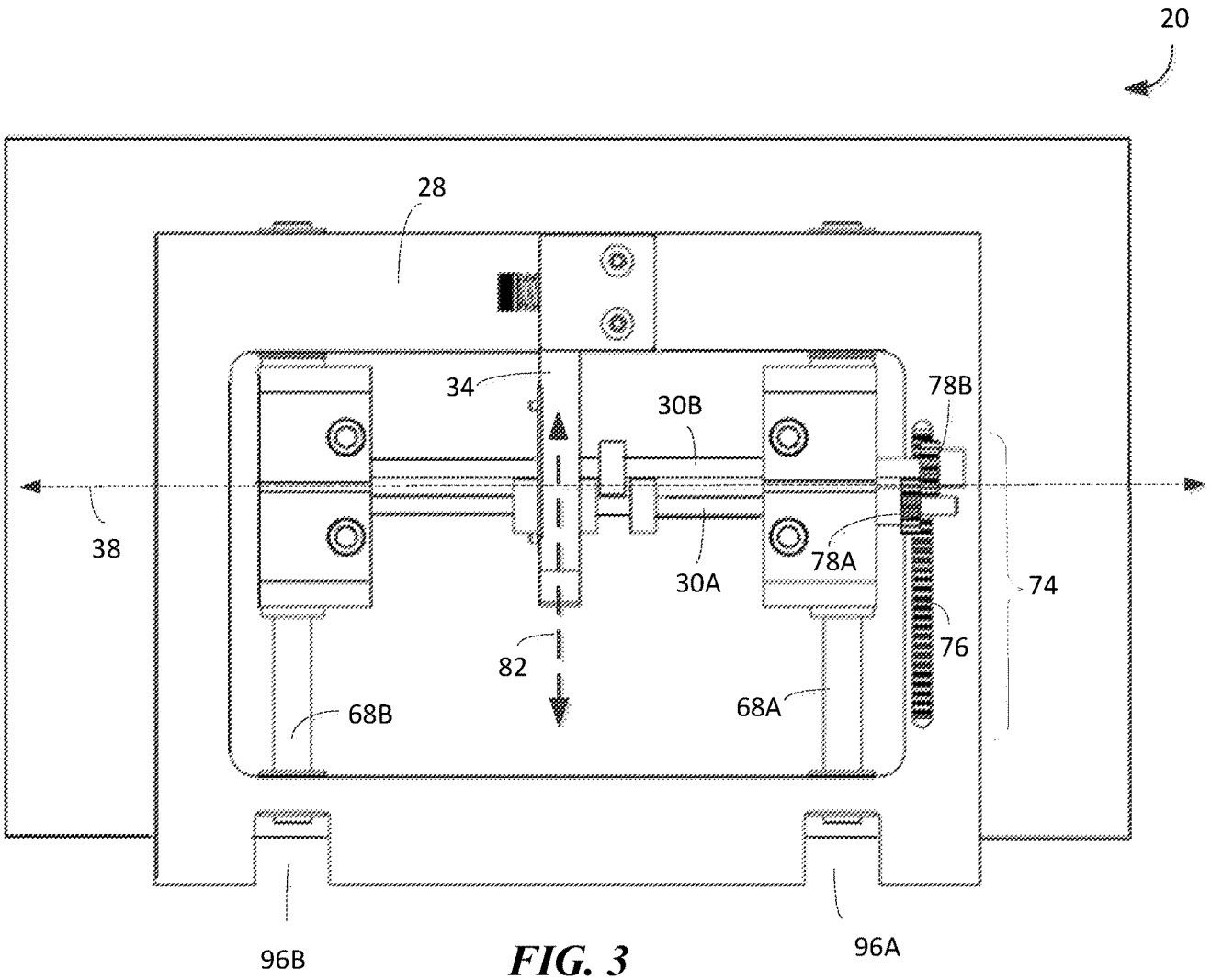
FIG. 3 illustrates a top view of the cutting device of FIG. 1, in accordance with at least one example of the present disclosure.

The sliding plate 28 can define an opening 62 that can enclose the first support block 24A and the second support block 24B. The sliding plate 28 can include a first side 64, a second side 66, a first slide shaft 68A, a second slide shaft 68B, a first slide bearing 72A, and a second slide bearing 72B. The first and second slide shafts 68A, 68B can extend from the first side 64 to the second side 66. The first and second slide shafts 68A, 68B can pass through apertures in the support blocks 24A, 24B and can be slidably coupled thereto. The first and second slide bearings 72A, 72B can be located between the slide shafts 68A, 68B and the support blocks 24A, 24B and can prevent wear. As illustrated in FIG. 3, the sliding plate 28 can be located above the base 22 so that movement of the sliding plate 28 does not interfere with the base 22.

Returning to FIG. 1, the cutting device 20 can include a rack and pinion assembly 74. The rack and pinion assembly 74 can include a rack 76, a first pinion gear 78A and a second pinion gear 78B. The rack 76 can include portions protruding from a top surface of the sliding plate 28 and can extend in a direction perpendicular to the longitudinal axis 38. The first pinion gear 78A can be located on the first roller shaft 30A and the second pinion gear 78B can be located on the second roller shaft 30B. The first pinion gear 78A and the second pinion gear 78B can be offset, so that they do not contact one another. The first pinion gear 78A and the second pinion gear 78B can engage the rack 76, such that when the sliding plate 28 is moved, the rack 76 causes the pinion gears 78A, 78B to rotate. As the pinion gears 78A, 78B rotate, the rollers 48A-E can rotate and can cause tubing positioned on the rollers 48A-E to rotate. When the sliding plate 28 is moved in the direction 84, the pinion gears 78A, 78B will rotate in a counterclockwise direction and vice versa.

The cutting device 20 can include a pivot block 80 coupled to the sliding plate 28. The pivot block 80 can be movably coupled to the arm 34. The arm 34 can extend in a second longitudinal axis 82 (see FIG. 3) that is perpendicular to the longitudinal axis 38. The arm 34 can swing up and down and be movable in a plane that is perpendicular to a plane of the longitudinal axis 38. Since the arm 34 can be moved relative to the support blocks 24A, 24B, the cutting blade 52 can be dimensioned to contact the tubing positioned along the longitudinal axis 38 during any movement of the sliding plate 28. Movement of the sliding plate 28 in direction 84 will cause the cutting blade 52 to be moved in direction 84 as the tube 86 is rotating (see FIG. 2). In another example, the pivot block 80 can be coupled to the base 22 and the cutting blade 52 can be positioned over the longitudinal axis 38.

Figure 2:
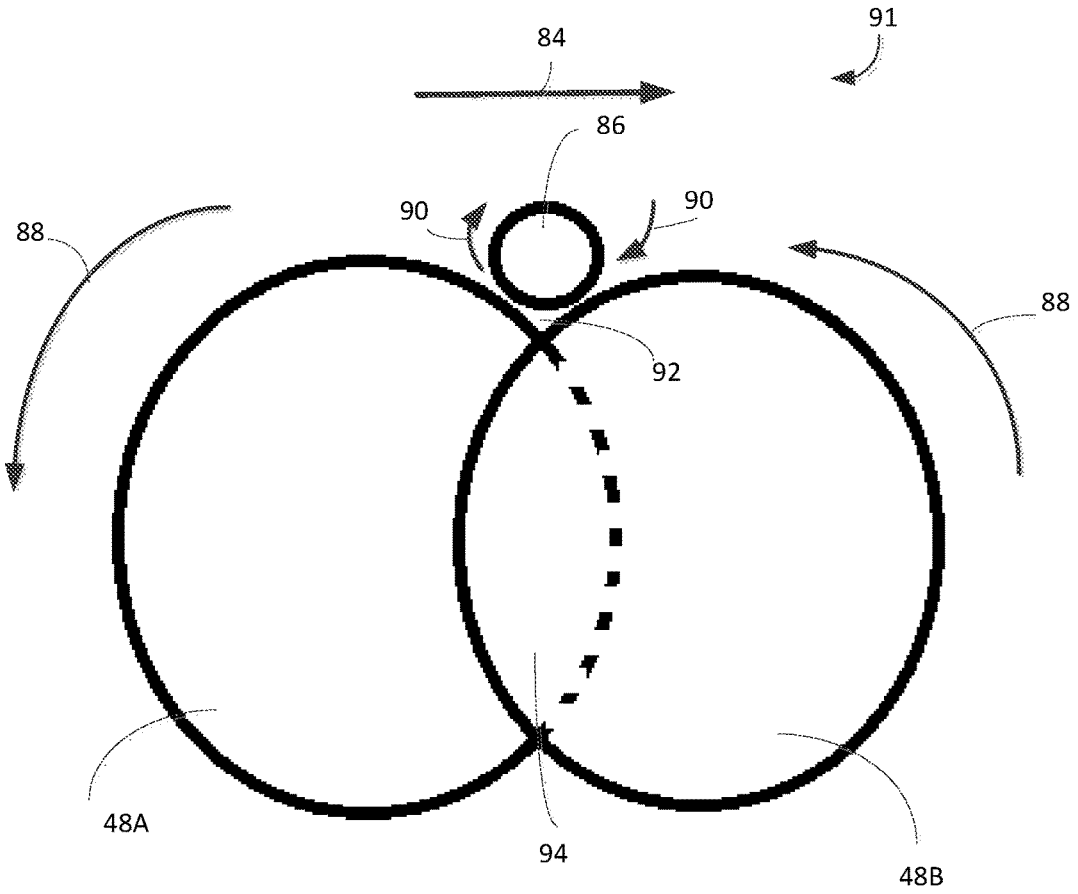
FIG. 2 illustrates a schematic view of roller and tube rotation, in accordance with at least one example of the present disclosure.

FIG. 2 illustrates a schematic view of roller and tubing rotation 91. A tube 86 can be positioned in a valley 92 formed by the overlapping roller portions 94 from each roller shaft. As shown, first and second rollers 48A, 48B rotate in a counterclockwise direction 88. The first roller 48A contacts the tube 86 on a lower left side. The second roller 48B contacts the tube 86 on a lower right side. Such contact pushes the left side of the tube 86 up and the right side of the tube 86 down and can cause the tube to rotate in the clockwise direction 90. Such a clockwise direction 90 can cause the top of the tube 86 to move in the same direction as the direction 84 that the sliding plate 28 moves (see FIG. 1). The present inventor has also contemplated a cutting device 20 that can cause the top of the tube 86 to move in a direction opposite that of the sliding plate without changing the intent of the present device.

FIG. 3 illustrates a top view of the cutting device 20 of FIG. 1. As illustrated, the arm 34 can extend along a second longitudinal axis 82 that can be perpendicular to the longitudinal axis 38. The first and second roller shafts 30A, 30B can be substantially parallel to the longitudinal axis 38. The sliding plate 28 can include a first recess 96A and a second recess 96B for the location of the first and second sliding shafts 68A, 68B. In the rack and pinion assembly 74, the first pinion gear 78A and the second pinion gear 78B can each occupy about half of the width of the rack 76, and can overlap each other without interfering with the gears of each other.

Figure 4:
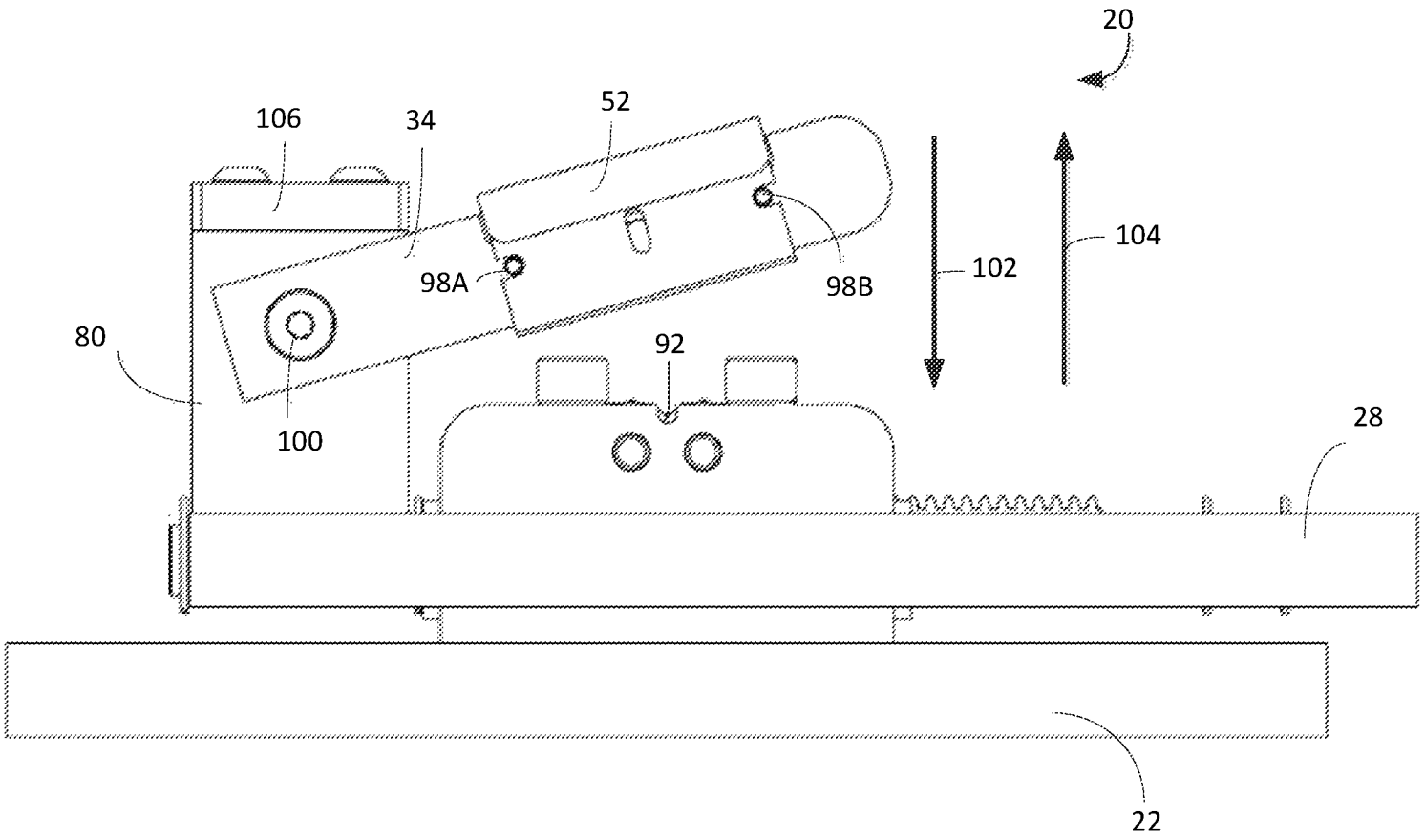
FIG. 4 illustrates a side view of the cutting device of FIG. 1, in accordance with at least one example of the present disclosure.

FIG. 4 illustrates a side view of the cutting device of FIG. 1. The cutting blade 52 can be a removable razor blade. In another example, the cutting blade 52 can be any form of a sharpened cutting tool. The cutting blade 52 can be mounted to the arm 34 by any fastening means, such as by fasteners 98A, 98B or by mounting pins. The arm 34 can be movably coupled to the pivot block 80 at a pivot point 100. The arm 34 can act as a lever and swing down 102 to perform a cut and swing up 104 to remain clear of the cutting area. An arm stop 106 can be fastened or formed integrally with the pivot block 80. The arm stop 106 can prevent the arm from further upward travel. The sliding plate 28 can be located above the base 22 so as not to interfere with the base 22 when the sliding plate 28 is moved. The cutting blade 52 can move in relation to the valley 92 as the sliding plate 28 is moved.

Figure 5:
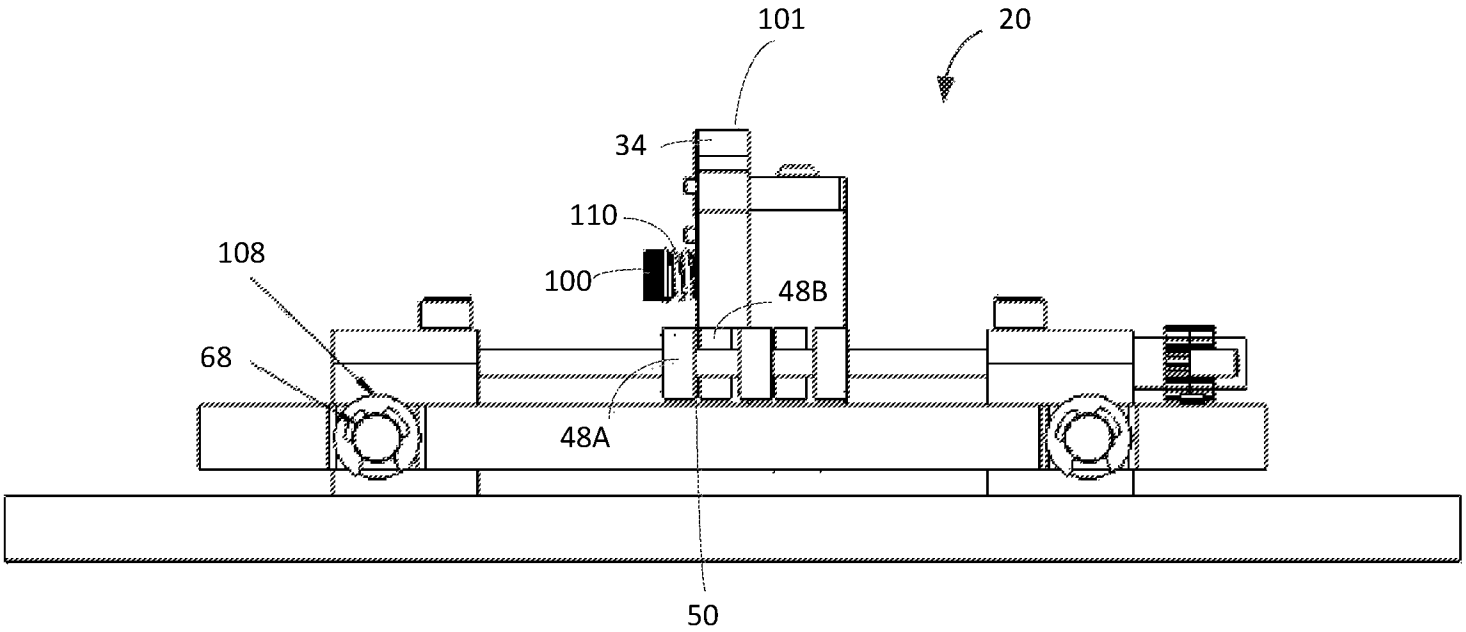
FIG. 5 illustrates a front view of the cutting device of FIG. 1, in accordance with at least one example of the present disclosure.

FIG. 5 illustrates a front view of the cutting device of FIG. 1. There can be a space 50 between the first roller 48A and the second roller 48B so that the cutting blade 52 can move downwardly sufficiently to cut a tube 86 that is positioned in the valley 92 (see FIG. 2). The end of the slide shaft 68 can be secured with a fastener 108. The fastener 108 can be an E-ring, a nut, a C-clip or a spring loaded washer. The pivot point 100 can include an energy storage member 110, such as a spring, a rubber bumper or a pneumatic cylinder, that can bias the arm 34 in an up position 101.

Figure 6:
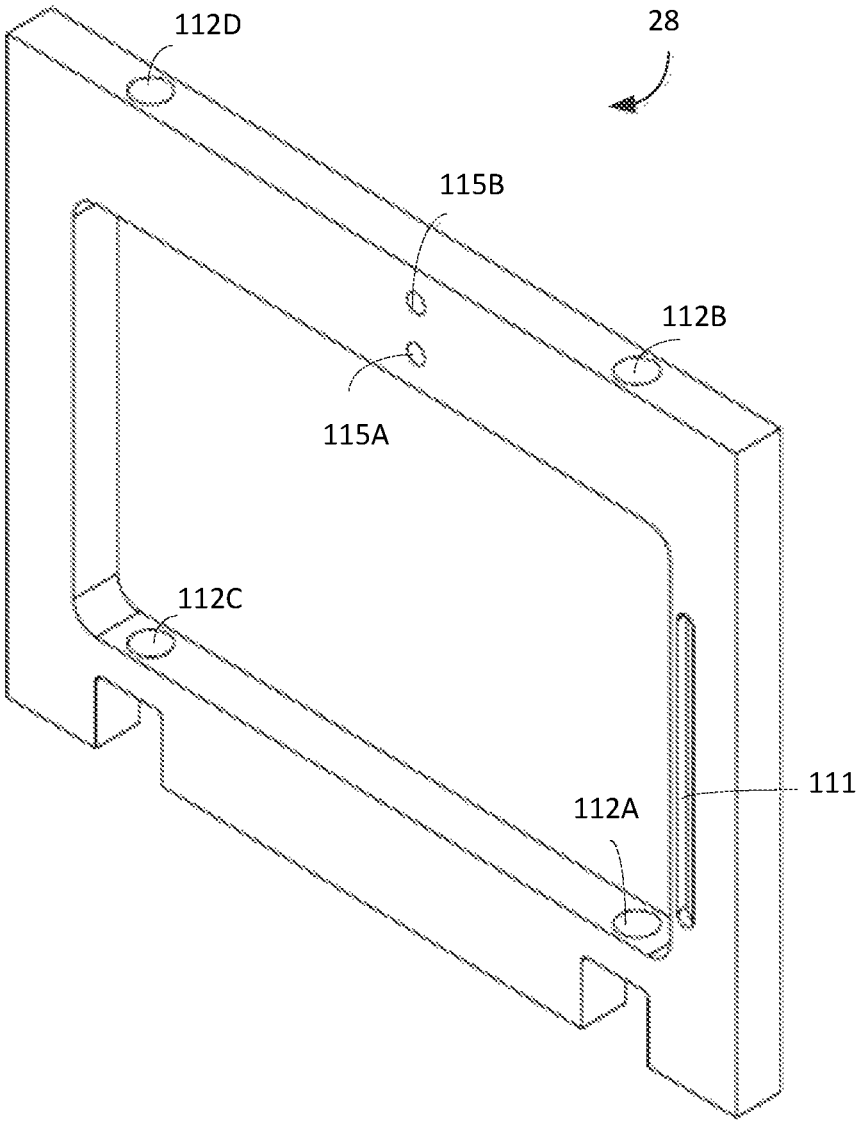
FIG. 6 illustrates a perspective view of a sliding plate, in accordance with at least one example of the present disclosure.

FIG. 6 illustrates a perspective view of a sliding plate 28. The sliding plate 28 can be rectangular. In another example, the sliding plate can have other shapes, such as an oval or an irregular shape having both curved and straight portions. The sliding plate 28 can include a cut out 111 that can receive the rack 76 (see FIG. 1). Sliding shaft apertures 112A, 112B, 112C and 112D can be formed in the sliding plate 28 to receive the sliding shafts. Tapped holes 115A and 115B can be utilized to attach the pivot block 80 (see FIG. 4).

Figure 7B:
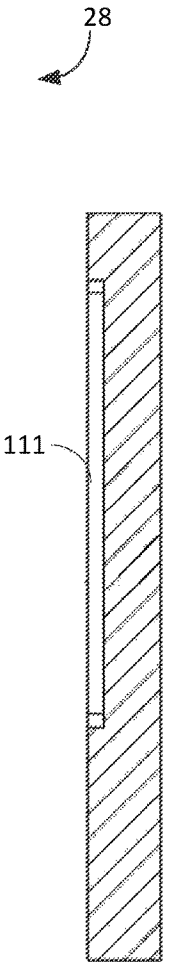
FIG. 7B illustrates a cross-sectional view of FIG. 7A, in accordance with at least one example of the present disclosure.
Figure 7A:
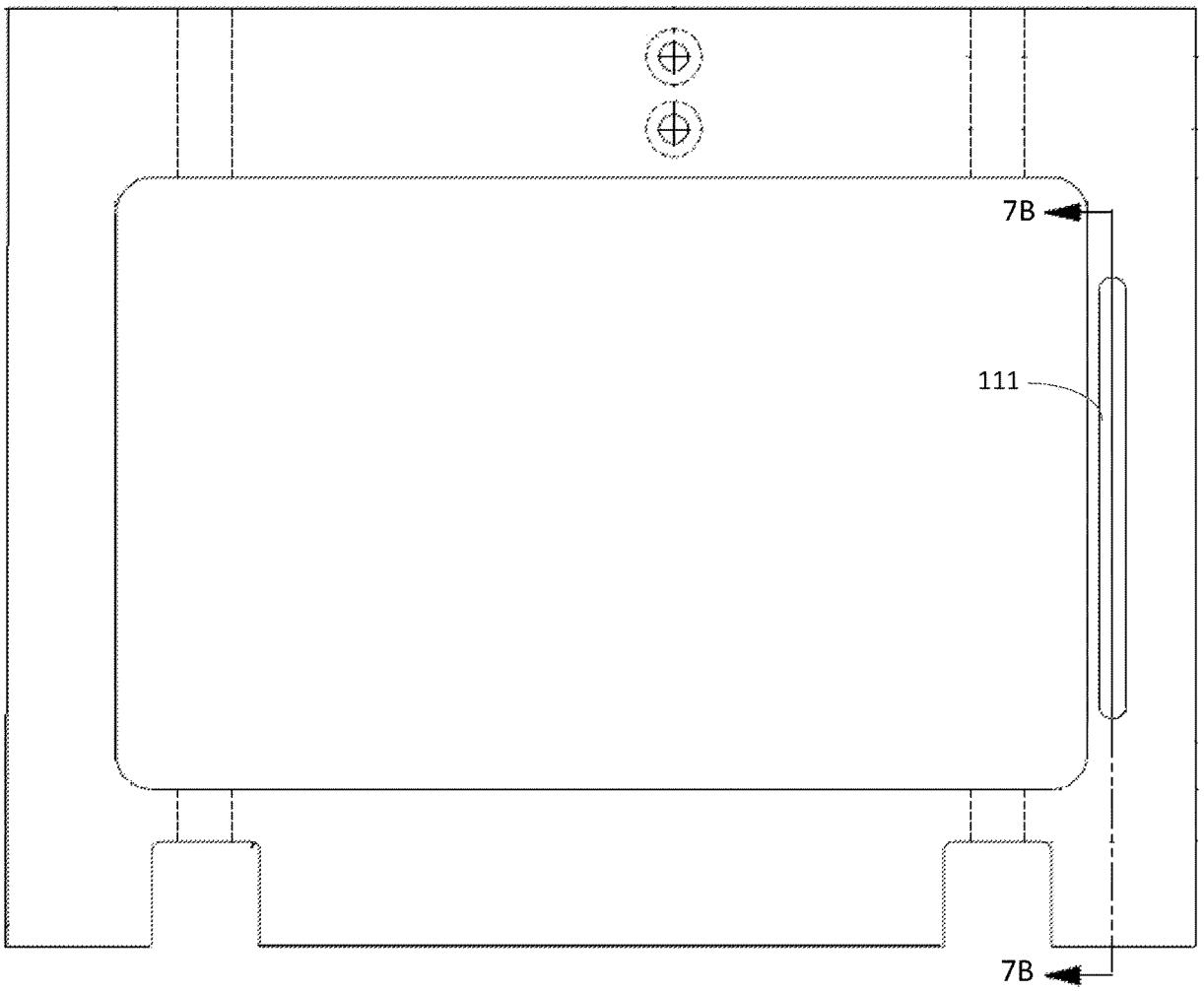
FIG. 7A illustrates a top view of the sliding plate of FIG. 6, in accordance with at least one example of the present disclosure.

FIG. 7A illustrates a top view of the sliding plate of FIG. 6.

FIG. 7B illustrates a cross-sectional view of FIG. 7A. The cut out 111 is shown in cross-section.

Figure 8B:
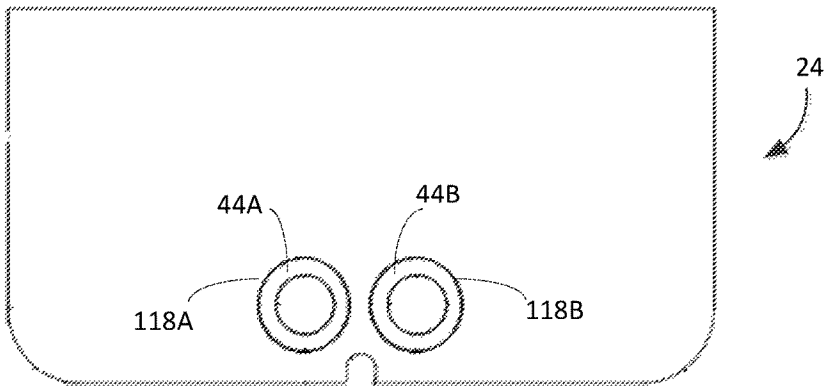
FIG. 8B illustrates a front view of the support block of FIG. 8A, in accordance with at least one example of the present disclosure.
Figure 8D:
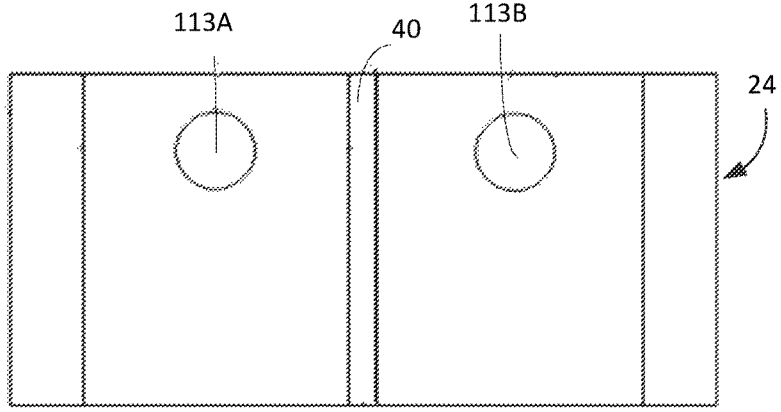
FIG. 8D illustrates a top view of the support block of FIG. 8A, in accordance with at least one example of the present disclosure.
Figure 8A:
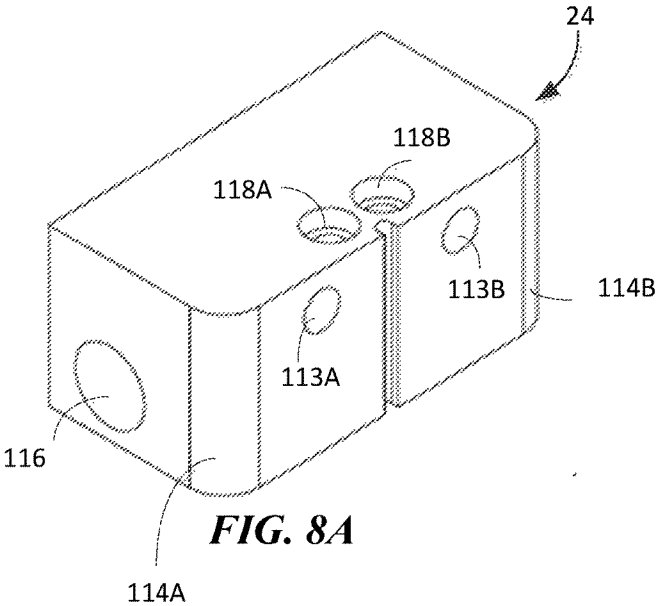
FIG. 8A illustrates a perspective view of a support block, in accordance with at least one example of the present disclosure.

FIG. 8A illustrates a perspective view of a support block. The support block 24 can include a first roller shaft aperture 118A, a second roller shaft aperture 118B, a sliding bearing aperture 116 and fastener apertures 113A, 113B. The support block 24 can include radiused corners 114A and 114B. The sliding bearing 72 can be received into the sliding bearing aperture 116 (see FIG. 1). In an alternative example, the sliding bearing 72 (see FIG. 1) may not be present and the sliding shaft 68 can be slidably coupled within the sliding bearing aperture 116.

FIG. 8B illustrates a front view of the support block of FIG. 8A. The first roller shaft aperture 118A and the second roller shaft aperture 118B can include roller shaft bearing members 44A, 44B.

Figure 8C:
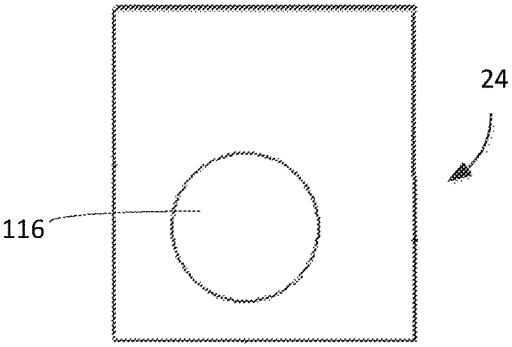
FIG. 8C illustrates a side view of the support block of FIG. 8A, in accordance with at least one example of the present disclosure.

FIG. 8C illustrates a side view of the support block of FIG. 8A. The support block 24 is shown with the sliding bearing aperture 116.

FIG. 8D illustrates a top view of the support block of FIG. 8A. The fastener apertures 113A, 113B can be used to receive fasteners to attach the support block 24 to the sliding plate 28 (see FIG. 1). Groove 40 can extend from one side of the support block 24 to the other.

Figure 9B:
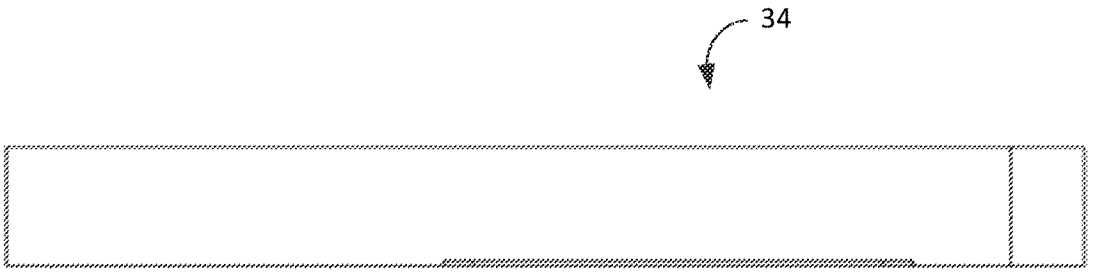
FIG. 9B illustrates a top view of the arm of FIG. 9A, in accordance with at least one example of the present disclosure.
Figure 9A:
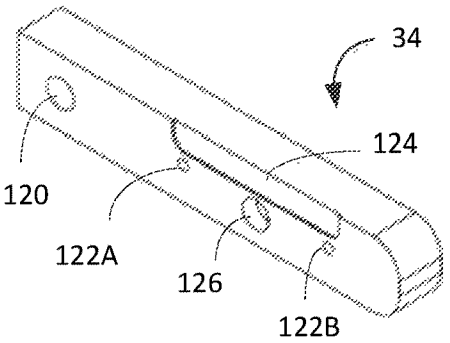
FIG. 9A illustrates a perspective view of an arm, in accordance with at least one example of the present disclosure.

FIG. 9A illustrates a perspective view of an arm 34. The arm 34 can include a blade recess 124, a pivot point aperture 120, blade pin apertures 122A, 122B and a blade removal aperture 126. Although the arm 34 is shown as a straight bar shape, the arm 34 can be shaped in any configuration that accommodates a pivot point and a desired cutting location and angle. The arm 34 can be straight, curved, or have a combination of straight and curved portions. The blade recess 124 can be formed to accommodate a razor blade having a stiffened backing. The blade pin apertures 122A, 122B can be threaded or non-threaded to receive a threaded fastener or a securing pin. The blade removal aperture 126 can be utilized to aid in removing an attached cutting blade. In the alternative, the blade removal aperture 126 can be threaded for an additional attachment point of the cutting blade to the arm 34.

FIG. 9B illustrates a top view of the arm of FIG. 9A.

Figure 9C:
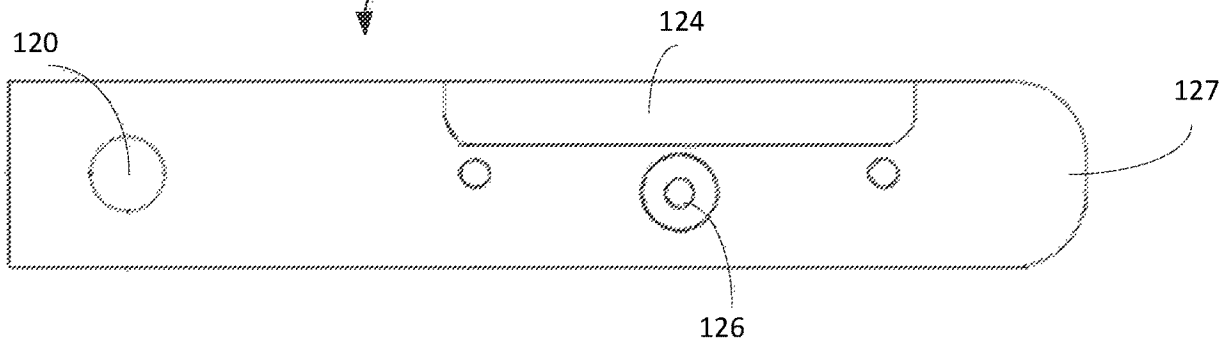
FIG. 9C illustrates a side view of the arm of FIG. 9A, in accordance with at least one example of the present disclosure.

FIG. 9C illustrates a side view of the arm of FIG. 9A. The arm 34 can have a rounded end 127 to aid in safe operation.

Figure 9D:
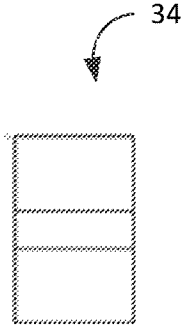
FIG. 9D illustrates a front view of the arm of FIG. 9A, in accordance with at least one example of the present disclosure.

FIG. 9D illustrates a front view of the arm of FIG. 9A.

Figure 10A:
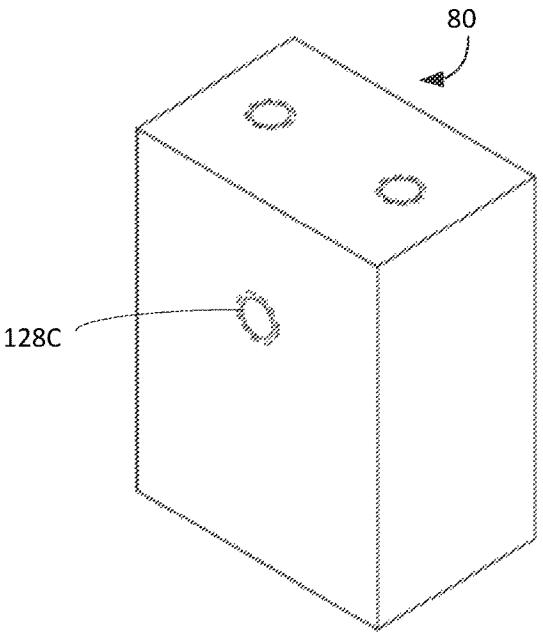
FIG. 10A illustrates a perspective view of a pivot block, in accordance with at least one example of the present disclosure.

FIG. 10A illustrates a perspective view of a pivot block 80. The pivot block 80 can include a tapped hole 128C for attachment of the arm 34 (see FIG. 4).

Figure 10D:
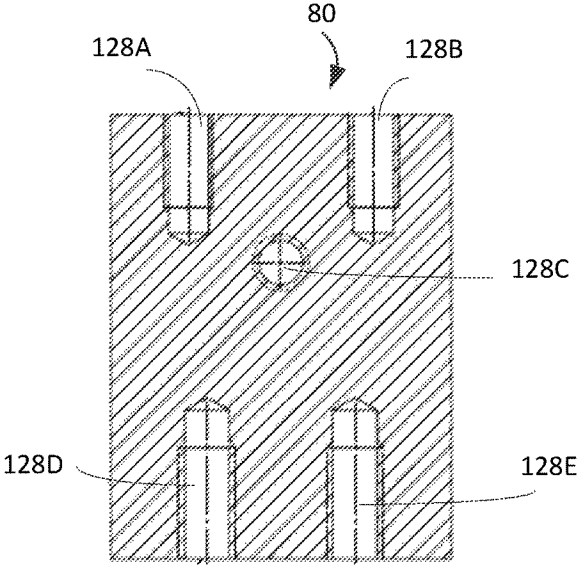
FIG. 10D illustrates a cross-sectional view of FIG. 10B, in accordance with at least one example of the present disclosure.
Figure 10B:
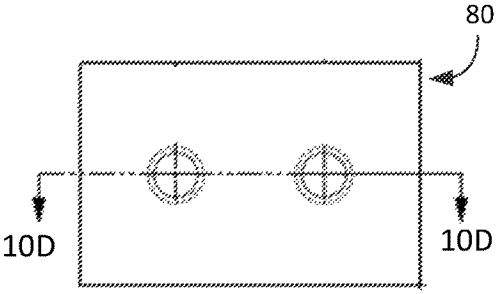
FIG. 10B illustrates a top view of the pivot block of FIG. 10A, in accordance with at least one example of the present disclosure.

FIG. 10B illustrates a top view of the pivot block of FIG. 10A.

Figure 10C:
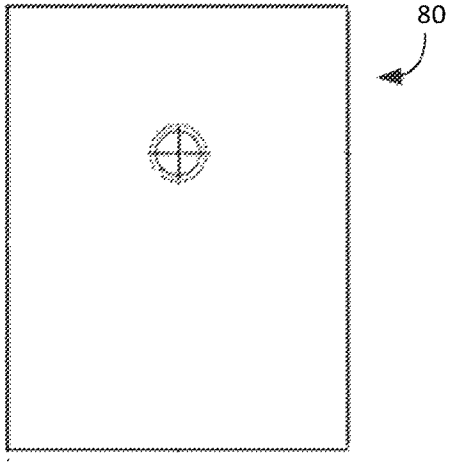
FIG. 10C illustrates a side view of the pivot block of FIG. 10A, in accordance with at least one example of the present disclosure.

FIG. 10C illustrates a side view of the pivot block of FIG. 10A.

FIG. 10D illustrates a cross-sectional view of FIG. 10B. The pivot block 80 can include tapped holes 128A, 128B for attachment of the arm stop 106. The pivot block 80 can include tapped holes 128D, 128E for attachment to the sliding plate 28 (see FIG. 1).

Figure 11B:
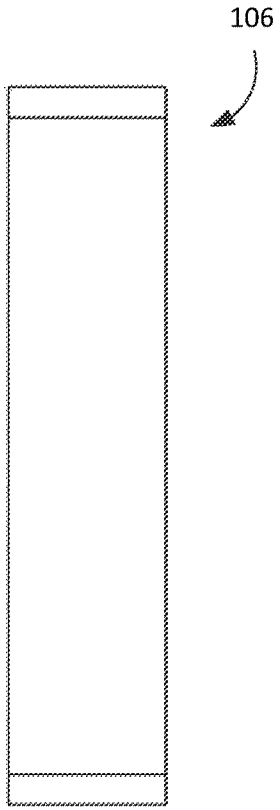
FIG. 11B illustrates a front view of the arm stop of FIG. 11A, in accordance with at least one example of the present disclosure.
Figure 11A:
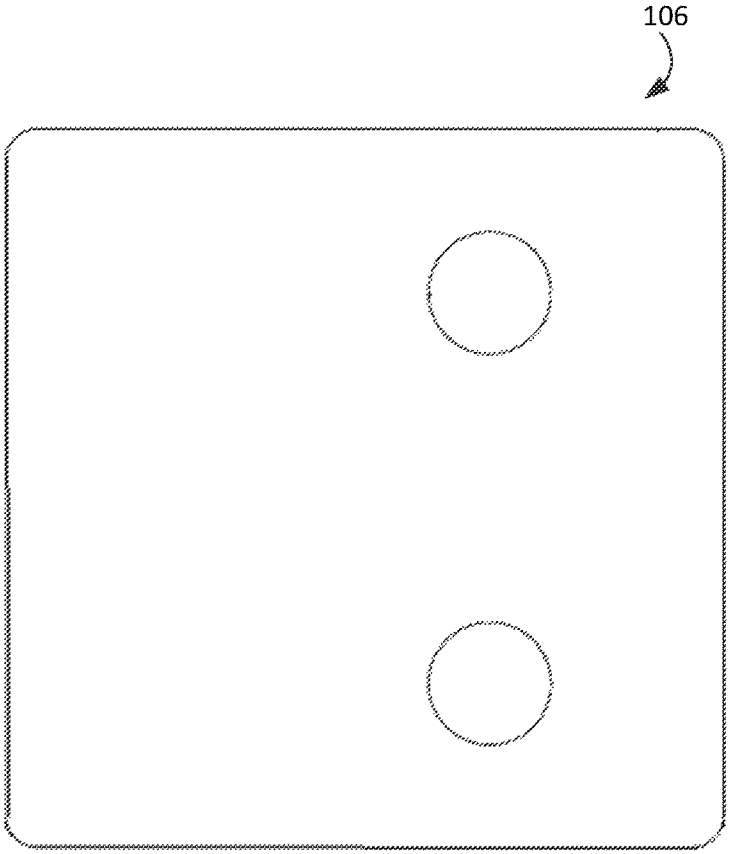
FIG. 11A illustrates a top view of an arm stop, in accordance with at least one example of the present disclosure.

FIG. 11A illustrates a top view of an arm stop 106.

FIG. 11B illustrates a front view of the arm stop 106 of FIG. 11A.

Certain terms are used throughout this patent document to refer to particular features or components. As one skilled in the art appreciates, different people may refer to the same feature or component by different names. This patent document does not intend to distinguish between components or features that differ in name but not in function.

For the following defined terms, certain definitions shall be applied unless a different definition is given elsewhere in this patent document. The terms "a," "an," and "the" are used to include one or more than one, independent of any other instances or usages of "at least one" or "one or more." The term "or" is used to refer to a nonexclusive or, such that "A or B" includes "A but not B," "B but not A," and "A and B." All numeric values are assumed to be modified by the term "about," whether or not explicitly indicated. The term "about" refers to a range of numbers that one of skill in the art would consider equivalent to the recited value (e.g., having the same function or result). In many instances, the term "about" can include numbers that are rounded to the nearest significant figure. The recitation of numerical ranges by endpoints includes all numbers and sub-ranges within and bounding that range (e.g., 1 to 4 includes 1, 1.5, 1.75, 2, 2.3, 2.6, 2.9, etc. and 1 to 1.5, 1 to 2, 1 to 3, 2 to 3.5, 2 to 4, 3 to 4, etc.).

The Detailed Description is intended to be illustrative and not restrictive. For example, the above-described examples (or one or more features or components thereof) can be used in combination with each other. Other embodiments can be used, such as by one of ordinary skill in the art upon reviewing the above Detailed Description. Also, various features or components have been or can be grouped together to streamline the disclosure. This should not be interpreted as intending that an unclaimed disclosed feature is essential to any claim. Rather, inventive subject matter can lie in less than all features of a particular disclosed embodiment. Thus, the following claim examples are hereby incorporated into the Detailed Description, with each example standing on its own as a separate embodiment:

In Example 1, a cutting device can comprise a base, first and second support blocks, first and second roller shafts, and a sliding plate. The first and second support blocks can be coupled to the base. The first and second roller shafts can extend between the first and second support blocks in a parallel manner and be movably coupled thereto. The sliding plate can be movably engaged with at least one of the first and second support blocks or the first and second roller shafts. Movement of the sliding plate can cause the first and second roller shafts to rotate in the same direction.

In Example 2, the cutting device of Example 1 can optionally be configured such that the sliding plate defines an opening that encloses the first and second support blocks.

In Example 3, the cutting device of Example 2 can optionally further comprise first and second slide shafts. The first slide shaft can extend from a first side of the opening to a second side of the opening and can be slidably coupled to the first support block. The second slide shaft can extend from the first side of the opening to the second side of the opening and can be slidably coupled to the second support block.

In Example 4, the cutting device of Example 3 can optionally be configured such that the first slide shaft extends through a first slide bearing, and the second slide shaft extends through a second slide bearing. The first slide bearing can extend at least partially through the first support block, and the second slide bearing can extend at least partially through the second support block.

In Example 5, the cutting device of any one or any combination of Examples 1-4 can optionally further comprise a rack and pinion assembly including a gear rack coupled to the sliding plate, a first pinion gear coupled to the first roller shaft, and a second pinion gear coupled to the second roller shaft. The first and second pinion gears can be movably engaged with the gear rack.

In Example 6, the cutting device of Example 5 can optionally be configured such that the movement of the sliding plate causes the gear rack to rotate the first and second pinion gears.

In Example 7, the cutting device of any one or any combination of Examples 1-6 can optionally further comprise a pivot block and an arm. The pivot block can be coupled to the sliding plate. The arm can be movably coupled to the pivot block and can extend along a longitudinal axis perpendicular to a longitudinal axis of the first and second roller shafts.

In Example 8, the cutting device of Example 7 can optionally further comprise a cutting blade removably coupled to the arm, where the arm is movable in a plane perpendicular to a plane of the first and second roller shafts.

In Example 9, the cutting device of any one or any combination of Examples 1-8 can optionally further comprise first and second rollers. The first roller can have a first radius positioned on the first roller shaft. The second roller can have a second radius positioned on the second roller shaft. The first radius can overlap the second radius in a direction perpendicular to a longitudinal axis of the first and second roller shafts.

In Example 10, the cutting device of Example 9 can optionally further comprise third and fourth rollers. The third roller can be positioned on the first roller shaft, adjacent to the second roller. The fourth roller can be positioned on the second roller shaft, adjacent to the third roller.

In Example 11, the cutting device of any one or any combination of Examples 9 and 10 can optionally be configured such that the first roller is spaced from the second roller so that a cutting blade can be inserted between these rollers.

In Example 12, a cutting device can comprise first and second support blocks, first and second roller shafts, a sliding plate, an arm, and a cutting blade. The first and second support block can be spaced from one another. The first and second roller shafts can extend at least partially through the first and second support blocks in a parallel manner and be movably coupled thereto. The sliding plate can be movably engaged with at least one of the first and second support blocks or the first and second roller shafts such that movement of the sliding plate causes the first and second roller shafts to rotate in the same direction. The arm, to which the cutting blade can be coupled, can longitudinally extend in a direct perpendicular to the extension of the first and second roller shafts.

In Example 13, the cutting device of Example 12 can optionally be configured such that the sliding plate defines an opening that encloses the first and second support blocks.

In Example 14, the cutting device of Example 13 can optionally further comprise first and second slide shafts. The first slide shaft can extend from a first side of the opening to a second side of the opening and can be slidably coupled to the first support block. The second slide shaft can extend from the first side of the opening to the second side of the opening and can be slidably coupled to the second support block.

In Example 15, the cutting device of Example 14 can be optionally configured such that the first slide shaft extends through a first slide bearing and the second slide shaft extends through a second slide bearing.

In Example 16, the cutting device of any one or any combination of Examples 12-15 can optionally further comprise a rack and pinion assembly including a gear rack coupled to the sliding plate, a first pinion gear coupled to the first roller shaft, and a second pinion gear coupled to the second roller shaft. The first and second pinion gears can be movably engaged with the gear rack.

In Example 17, the cutting device of any one or any combination of Examples 12-16 can optionally further comprise first and second rollers. The first roller can have a first radius positioned on the first roller shaft, and the second roller can have a second radius positioned on the second roller shaft. The first radius can overlap the second radius in a direction perpendicular to a longitudinal axis of the first and second roller shafts.

In Example 18, the cutting device of Example 17 can optionally further comprise third and fourth rollers. The third roller can be positioned on the first roller shaft, adjacent to the second roller. The fourth roller can be positioned on the second roller shaft, adjacent to the third roller.

In Example 19, the cutting device of any one or any combination of Examples 17 and 18 can optionally be configured such that the first roller is spaced apart from the second roller so that a cutting blade can be inserted between these rollers.

In Example 20, a method can comprise place a tube on a cutting platform and cutting the tube. The cutting platform can include first and second support blocks and first and second roller shafts. Each of the first and second support blocks can have a groove configured to receive a portion of the tube. Each of the first and second roller shafts can extend at least partially through and be movably coupled to the first and second support blocks. Cutting the tube can include moving a sliding plate, which is engaged with at least one of the first and second roller shafts to cause rotation of the tube, and pressing a cutting blade into rotating tube.

The scope of the cutting device and related methods should be determined with reference to the appended claims, along with the full scope of equivalents to which such claims are entitled. In the appended claims, the terms "including" and "in which" are used as the plain-English equivalents of the respective terms "comprising" and "wherein." Also, in the following claims, the terms "including" and "comprising" are open-ended; that is, a device or method that includes features or components in addition to those listed after such a term in a claim are still deemed to fall within the scope of that claim. Moreover, in the following claims, the terms "first," "second," and "third," etc. are used merely as labels, and are not intended to impose numerical requirements on their objects.

The Abstract is provided to allow the reader to quickly ascertain the nature of the technical disclosure. It is submitted with the understanding that it will not be used to interpret or limit the scope or meaning of the claims.

What is claimed is:

1. A cutting device, comprising:

a base;

a first support block defining a first groove and coupled to the base;

a second support block defining a second groove and coupled to the base, the second groove aligned along a longitudinal axis with the first groove;

a first roller shaft extending between and movably coupled to the first support block and the second support block;

a second roller shaft extending between and movably coupled to the first support block and the second support block, the second roller shaft substantially parallel to the first roller shaft; and a sliding plate movably engaged with at least one of the first and second support blocks or the first and second roller shafts, wherein movement of the sliding plate causes the first roller shaft and the second roller shaft to rotate in the same direction, wherein the first and second grooves align with an overlapping intersection of an assembly of rollers positioned on the first and second roller shafts.

2. The cutting device of claim 1, wherein the sliding plate defines an opening that encloses the first and second support blocks.

3. The cutting device of claim 2, further comprising:

a first slide shaft extending from a first side of the opening to a second side of the opening, the first slide shaft slidably coupled to the first support block; and a second slide shaft extending from the first side of the opening to the second side of the opening, the second slide shaft slidably coupled to the second support block.

4. The cutting device of claim 3, wherein the first slide shaft extends through a first slide bearing, the first slide bearing extending at least partially through the first support block; and wherein the second slide shaft extends through a second slide bearing, the second slide bearing extending at least partially through the second support block.

5. The cutting device of claim 1, further comprising a rack and pinion assembly including a gear rack coupled to the sliding plate, a first pinion gear coupled to the first roller shaft, and a second pinion gear coupled to the second roller shaft, the first pinion gear and the second pinion gear movably engaged with the gear rack.

6. The cutting device of claim 5, wherein the movement of the sliding plate causes the gear rack to rotate the first and second pinion gears.

7. The cutting device of claim 1, further comprising:

a pivot block coupled to the sliding plate; and an arm movably coupled to a tapped hole defined by the pivot block, the arm extending along a longitudinal axis perpendicular to a longitudinal axis of the first and second roller shafts.

8. The cutting device of claim 7, further comprising a cutting blade removably coupled to the arm, the arm movable in a plane perpendicular to a plane of the first and second roller shafts.

9. The cutting device of claim 1, wherein the assembly of rollers comprises:

a first roller having a first radius positioned on the first roller shaft; and a second roller having a second radius positioned on the second roller shaft, the first radius overlapping the second radius in a direction perpendicular to a longitudinal axis of the first and second roller shafts.

10. The cutting device of claim 9, further comprising:

a third roller positioned on the first roller shaft, adjacent to the second roller; and a fourth roller positioned on the second roller shaft, adjacent to the third roller.

11. The cutting device of claim 9, wherein the first roller is spaced from the second roller such that a cutting blade can be inserted between the first roller and the second roller.

12. A cutting device, comprising:

a first support block defining a first groove;

a second support block defining a second groove and spaced from the first support block, the second groove aligned along a longitudinal axis with the first groove;

a first roller shaft extending at least partially through and movably coupled to the first and second support blocks;

a second roller shaft extending at least partially through and movably coupled to the first and second support blocks, the second roller shaft extending substantially parallel to the first roller shaft;

a sliding plate movably engaged with at least one of the first and second support blocks or the first and second roller shafts such that movement of the sliding plate causes the first roller shaft and the second roller shaft to rotate in the same direction;

an arm longitudinally extending in a direction perpendicular to the extension of the first and second roller shafts; and a cutting blade coupled to the arm, wherein the first and second grooves align with an overlapping intersection of an assembly of rollers positioned on the first and second roller shafts.

13. The cutting device of claim 12, wherein the sliding plate defines an opening that encloses the first and second support blocks.

14. The cutting device of claim 13, comprising:

a first slide shaft extending from a first side of the opening to a second side of the opening, the first slide shaft slidably coupled to the first support block; and a second slide shaft extending from the first side of the opening to the second side of the opening, the second slide shaft slidably coupled to the second support block.

15. The cutting device of claim 14, wherein the first slide shaft extends through a first slide bearing; and wherein the second slide shaft extends through a second slide bearing.

16. The cutting device of claim 12, further comprising a rack and pinion assembly including a gear rack coupled to the sliding plate, a first pinion gear coupled to the first roller shaft, and a second pinion gear coupled to the second roller shaft, the first pinion gear and the second pinion gear movably engaged with the gear rack.

17. The cutting device of claim 12, wherein the assembly of rollers comprises:

a first roller having a first radius positioned on the first roller shaft; and a second roller having a second radius positioned on the second roller shaft, the first radius overlapping the second radius in a direction perpendicular to a longitudinal axis of the first and second roller shafts.

18. The cutting device of claim 17, further comprising:

a third roller positioned on the first roller shaft, adjacent to the second roller; and a fourth roller positioned on the second roller shaft, adjacent to the third roller.

19. The cutting device of claim 17, wherein the first roller is spaced apart from the second roller such that a cutting blade can be inserted between the first roller and the second roller.

20. A method, comprising;

placing a tube on a cutting platform, the cutting platform including:

a first support block having a first groove configured to receive a first portion of the tube, a second support block having a second groove configured to receiving a second portion of the tube, the second groove aligned along a longitudinal axis with the first groove, a first roller shaft extending at least partially through and movably coupled to the first and second support blocks, and a second roller shaft extending at least partially through and movably coupled to the first and second support blocks, the second roller shaft extending substantially parallel to the first roller shaft, wherein the first and second grooves align with an overlapping intersection of an assembly of rollers positioned on the first and second roller shafts; and cutting the tube, including:

moving a sliding plate, the sliding plate engaging at least one of the first and second roller shafts causing the shafts to rotate in the same direction and actuating rotation of the tube, and pressing a cutting blade into the rotating tube as the sliding plate is moved.

* * * * *